US009151071B1

(12) United States Patent
Amasiani

(10) Patent No.: US 9,151,071 B1
(45) Date of Patent: Oct. 6, 2015

(54) PERSONALIZED MEMORIAL DISPLAY

(71) Applicant: Beatrice Denise Amasiani, Detroit, MI (US)

(72) Inventor: Beatrice Denise Amasiani, Detroit, MI (US)

( * ) Notice: Subject to any disclaimer, the term of this patent is extended or adjusted under 35 U.S.C. 154(b) by 0 days.

(21) Appl. No.: 14/585,971

(22) Filed: Dec. 30, 2014

Related U.S. Application Data

(60) Provisional application No. 62/015,563, filed on Jun. 23, 2014.

(51) Int. Cl.
*E04H 13/00* (2006.01)

(52) U.S. Cl.
CPC ..... *E04H 13/003* (2013.01); *E04H 13/001* (2013.01)

(58) Field of Classification Search
CPC ..... A61G 17/08; E04H 13/003; E04H 13/008
USPC ..... 52/103, 104, 128
See application file for complete search history.

(56) References Cited

U.S. PATENT DOCUMENTS

| | | | | | |
|---|---|---|---|---|---|
| 232,782 | A * | 9/1880 | Townsend | 27/1 |
| 1,287,683 | A * | 12/1918 | Harman | 52/38 |
| 5,813,642 | A * | 9/1998 | Warren | 248/229.15 |
| 6,023,822 | A * | 2/2000 | Luebke | 27/1 |
| 6,447,359 | B1 * | 9/2002 | Crump | 446/100 |
| 6,785,938 | B1 * | 9/2004 | Johansen, Jr. | 27/1 |
| 7,370,394 | B1 * | 5/2008 | Juneau | 27/1 |
| 2005/0120525 | A1 * | 6/2005 | Heil et al. | 27/1 |
| 2013/0061540 | A1 * | 3/2013 | Denney | 52/103 |

* cited by examiner

*Primary Examiner* — Mark Wendell

(57) ABSTRACT

The personalized memorial display provides an aesthetically pleasant means for celebrating the life of an individual at their respective final resting place. The apparatus includes a human-shaped body, a structurally rigid support, a backing, a glazing, and a customized etching. The customized etching is a personalized statement regarding the passed individual that is imprinted into the glazing in order to preserve the memory of said individual for as long as the memorial stands. The glazing is held within the body and covered and supported by the backing, ensuring longevity of the glazing and thus the memory of the departed. The body is raised above the ground and supported by the rigid support. The apparatus acts as a permanent memorial to the memory of an individual.

15 Claims, 5 Drawing Sheets

PERSONALIZED MEMORIAL DISPLAY

The current application claims a priority to the U.S. Provisional Patent application Ser. No. 62/015,563 filed on Jun. 23, 2014.

FIELD OF THE INVENTION

The present invention relates generally to memorials for loved ones who have passed. More specifically, the present invention is a memorial display figure that bears the general shape of a person and has a brightly colored and lit screen which shows details of the person being memorialized.

BACKGROUND OF THE INVENTION

Whenever a person dies, there is always a great amount of grief and sadness that is experience by those who were close to the passed person. Such grief and sadness subsides over time, however there are some therapeutic actions which can help to ease the transition out of mourning for those that were close to someone who has passed away. These therapeutic actions include for example, visiting the person's grave site and placing flowers, placing other objects such as balloons or wreaths at the grave site, and creating small memorials or temporary shrines to those who have been lost. Such small memorials and shrines are especially common when a tragedy occurs that unexpectedly claims the lives of many people, both young and old. Some memorials are often set up at or near the site of the tragedy, and are visited by many people who wish to mourn those that have died. Unfortunately, such memorials are often very temporary and must eventually be removed such that normal life may continue on. The removal of the memorial can sometimes happen too soon for those who have not completed grieving. Of course, those who still wish to mourn may visit the grave site of their loved ones. Grave sites are almost always located in cemeteries which can often be dark and foreboding places, especially for young children who may be easily unsettled in the presence of so many graves.

It is the object of the present invention to create a memorial display figure which serves as a visual memorial to help those grieving come to terms with the loss of their loved ones. The memorial is a permanent positive expression of a lost loved one. The memorial allows a community to express compassion for those who are grieving due to their recent loss. This memorial also gives the living a venue to express their loss by having a forum to express what the loved one meant to them. Far too often we see make shift memorials of crosses, flowers, and stuffed teddy bears, but we don't know anything about the person. We may wonder who were they, were they young or old, did they have children, did they live nearby, where did they go to school. So many questions, but no answers. We only know that someone has pasted. This invention allows for that information to be shared. The memorial display figure is intended to allow people to memorialize their loved ones in an alternative way to visiting a permanent grave site. Additionally, the present invention can be very useful for people who have moved far away from the grave of their lost loved ones and as a result, cannot visit the grave as often as they may want to. The present invention may also serve well in impromptu memorials for those that have been claimed by tragedies to allow the community to mourn. This memorial acts as a broad board to communicate the passing of a person. It is a further object of the present invention to allow for the creation of memorial parks which may serve as an alternative to cemeteries as a place for people to go to mourn their lost loved ones. Such a memorial park may be a bright and beautiful place, complete with playgrounds and swings amid the memorials to help families to mourn their loss through a colorful environment that depicts a pleasant story line through visual scenic display of relative activities that the deceased may have enjoyed. It is a visual expression of love for a loss one.

Not only is the present invention a memorial display, it can also be used as a celebratory expression or celebratory display.

DETAILED DESCRIPTIONS OF THE INVENTION

All illustrations of the drawings are for the purpose of describing selected versions of the present invention and are not intended to limit the scope of the present invention.

The present invention is an alternative form of a memorial. More specifically, the present invention is a unique memorial that utilizes a see through canvas to display individually customized information regarding the deceased person(s). The present invention lends itself to be utilized in a variety of environments other than traditional memorial sites; such places include, but are not limited to, parks, streets, or backyards. The present invention allows for an individual to have a colorful and respectful way to honor the loss of a loved one; an alternative to makeshift teddy bears, hand-made posters, flowers with crosses placed in the ground where the person may have lost their lives. The memorial is respectful, colorful, descriptive, and personalized.

Figure 2:
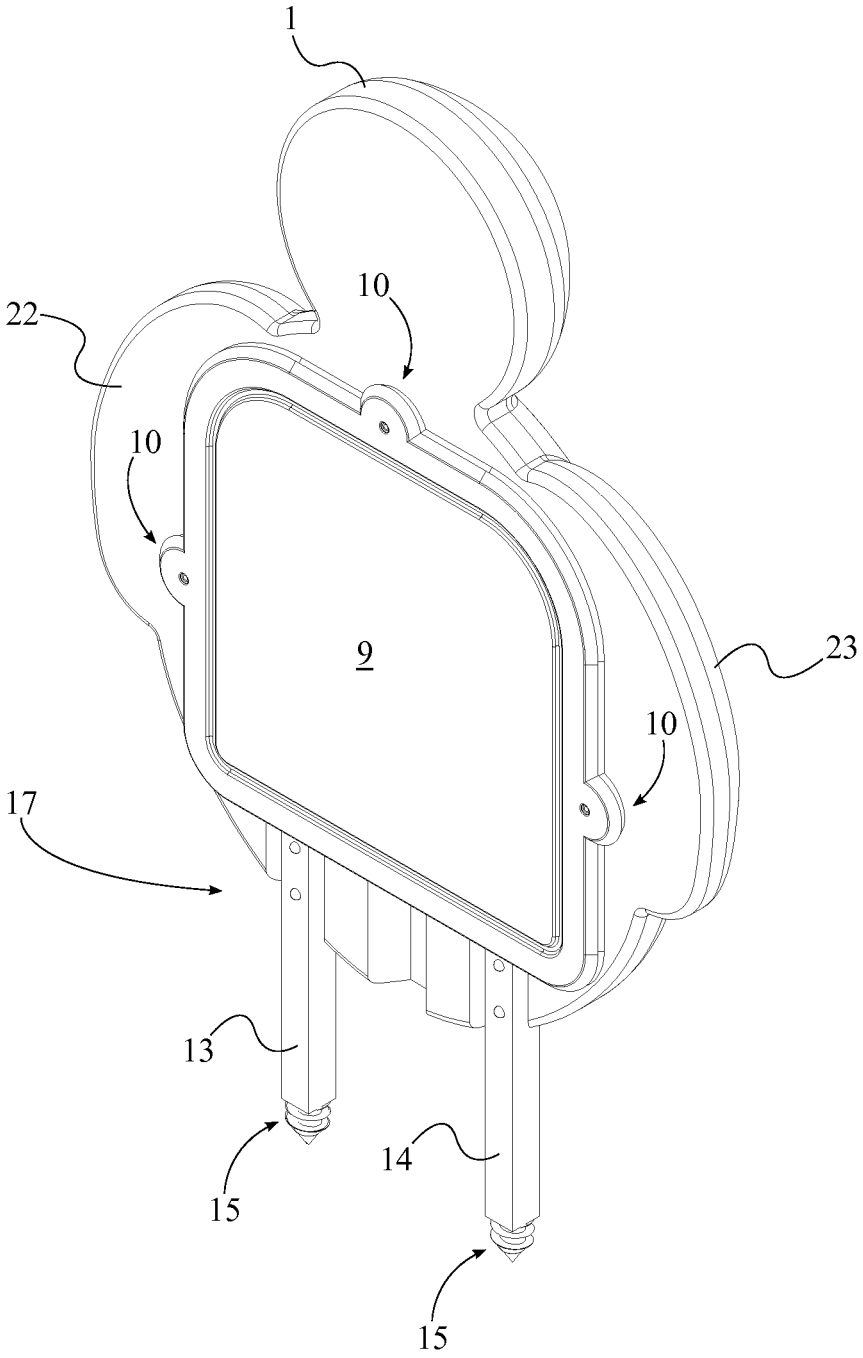
FIG. 2 is a rear perspective view of the present invention.

The present invention comprises a head-shaped structural piece 1, a torso-shaped structural piece 2, a glazing 7, a backing 9, a first leg 13, a second leg 14, and a customized etching 12. The head-shaped structural piece 1 is adjacently connected to the torso-shaped structural piece 2. The head-shaped structural piece 1 and the torso-shaped structural piece 2 provide the structural medium for holding and displaying the customized etching 12. The customized etching 12 is cut into the glazing 7 and is housed inside the torso-shaped structural piece 2. The backing 9 encloses and protects the housing within which the glazing 7 is held as can be seen in FIG. 2. The first leg 13 and second leg 14 elevate and provide structural support for the present invention, ensuring an upright orientation. The customized etching 12 is a means of conveying content about the passed individual(s). Content that may be utilized for the customized etching 12 include, but are not limited to, letters, numbers, religious symbols, short passages, quotes, pictures, logos, symbols, and/or other visual items. In the preferred embodiment, the lettering and numbers on the screen may include information such as a short obituary, the date of birth, and the date of passing; the customized etching 12 might also include a picture of the individual.

Figure 1:
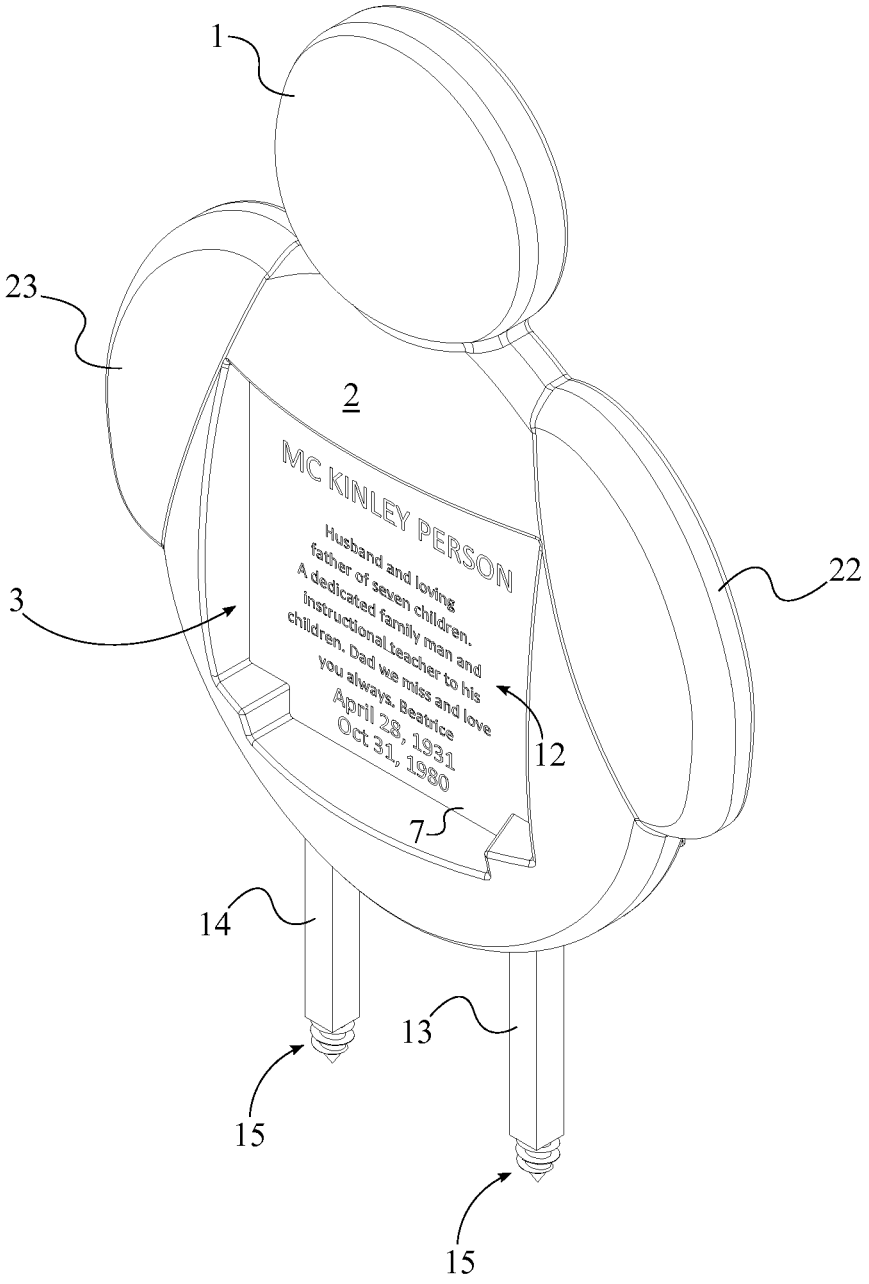
FIG. 1 is a front perspective view of the present invention.

In the preferred embodiment, the present invention also comprises a left arm-shaped structural piece 22 and a right arm-shaped structural piece 23 for stability purposes. The left arm-shaped structural piece 22 is adjacently connected to the torso-shaped structural piece 2; the right arm-shaped structural piece 23 is adjacently connected to the torso-shaped structural piece 2, opposite to the left arm-shaped structural piece 22. The head-shaped structural piece 1, the torso-shaped structural piece 2, the left arm-shaped structural piece 22, and the right arm-shaped structural piece 23 make up the body of the present invention and are preferably shaped to resemble the outline of a human body starting from the waist up with the torso-shaped structural piece 2 resembling a full hearted design as seen in FIG. 1. The combined shape of the head-shaped structural piece 1, the torso-shaped structural piece 2, the left arm-shaped structural piece 22, and the right arm-shaped structural piece 23 is intended to be androgynous and shaped similar to a human upper torso such that the present invention may be used to memorialize both males and females. For added stability the front of the mentioned body components protrude forwards a certain length with rounded contours which resemble a human figure, this is seen in FIG. 1.

Figure 3:
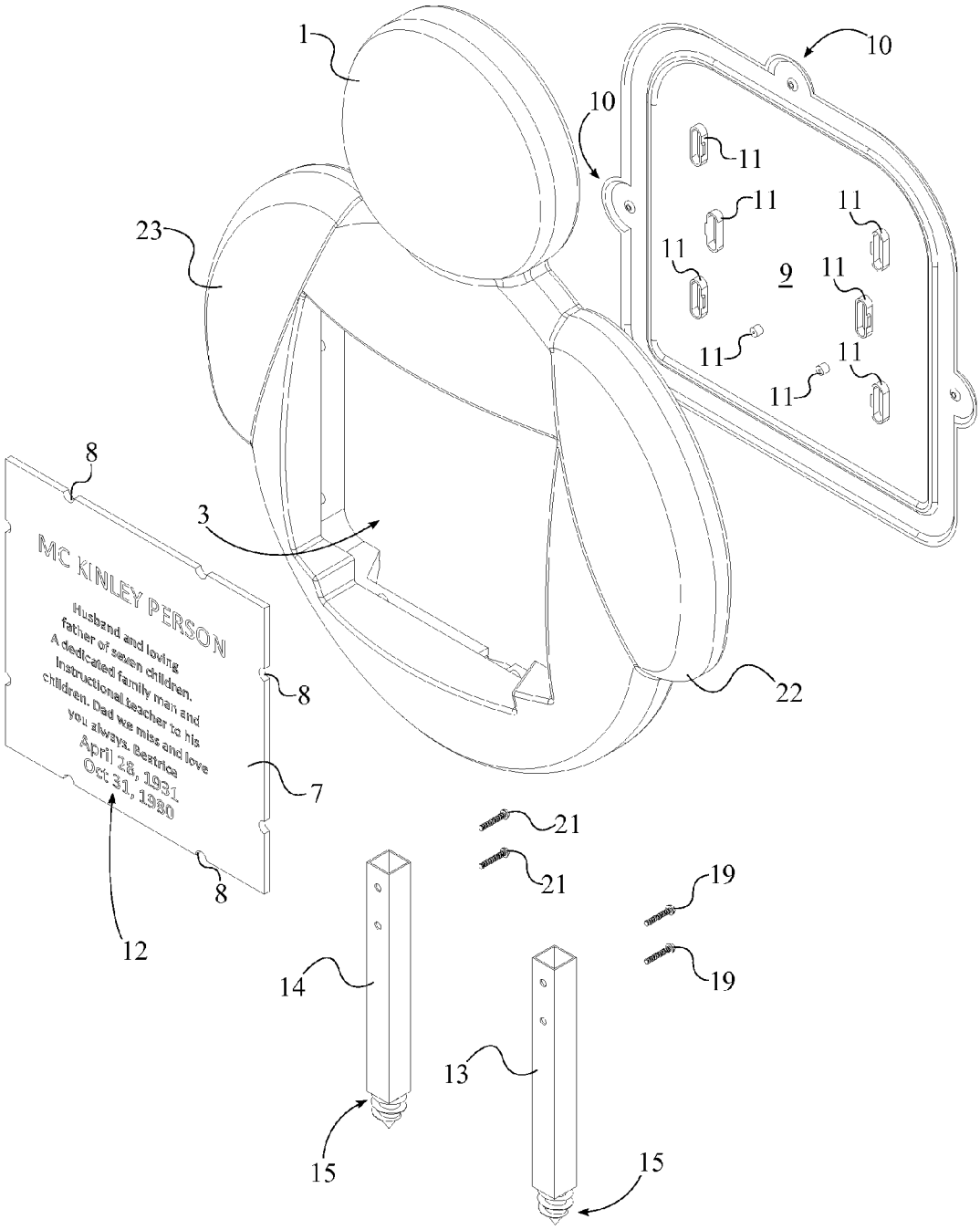
FIG. 3 is a front exploded perspective view of the present invention.

The torso-shaped structural piece 2 comprises a mounting cavity 4 and a framing hole 3. The mounting cavity 4 traverses into the torso-shaped structural piece 2 and facilitates the attachment of the glazing 7 and backing 9 to the torso-shaped structural piece 2. In a similar fashion, the framing hole 3 traverses into the torso-shaped structural piece 2, opposite the mounting cavity 4 as seen in FIG. 3. The framing hole 3 is positioned in between the left arm-shaped structural piece 22 and the right arm-shaped structural piece 23. The customized etching 12 is positioned on the glazing 7 and the glazing 7 is positioned within the mounting cavity 4, adjacent to the framing hole 3. The glazing 7 may be flat or partially curved, bubble like. The framing hole 3 and the mounting cavity 4 are positioned coincidently with each other resulting in a hollowed region in the torso-shaped structural piece 2; essentially turning the framing hole 3 into a viewing window for the glazing 7.

Figure 4:
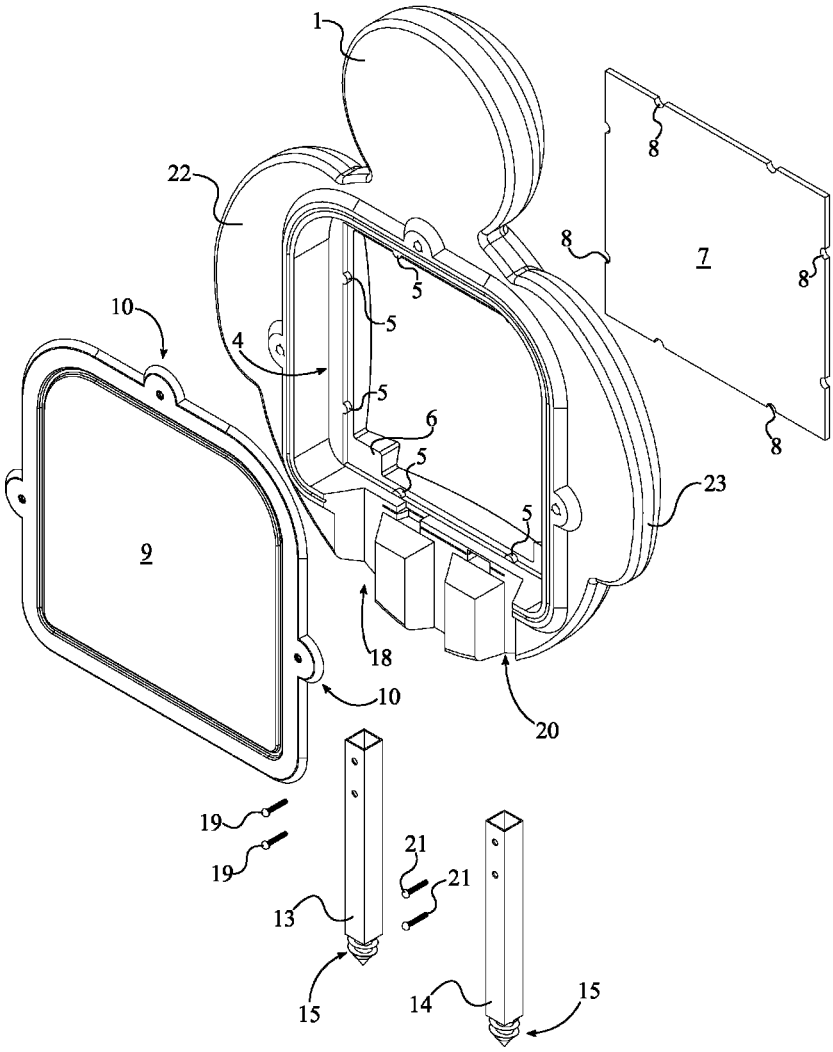
FIG. 4 is a rear exploded perspective view of the present invention.

In the preferred embodiment, a plurality of notches 8, a plurality of tabs 5, and a glazing-receiving lip 6 are utilized to facilitate a more snug fit of the glazing 7 inside the mounting cavity 4. The glazing 7 comprises a plurality of notches 8 and the mounting cavity 4 comprises a plurality of tabs 5. The plurality of notches 8 is perimetrically distributed around the glazing 7. In addition, the plurality of notches 8 laterally traverses into the glazing 7 as seen in FIG. 3. In a similar fashion, the plurality of tabs 5 is perimetrically distributed around the mounting cavity 4 as well as laterally traverses into the mounting cavity 4 as seen in FIG. 4. The glazing-receiving lip 6 is integrated into the torso-shaped structural piece 2 from the mounting cavity 4. The glazing 7 is positioned within the glazing-receiving lip 6 with each of the plurality of tabs 5 being positioned into a corresponding notch from the plurality of notches 8; this prevents lateral and vertical translation of the glazing 7.

The backing 9 is attached to the mounting cavity 4, opposite the framing hole 3, and as such provides protection and support for the glazing 7 and the customized etching 12. In the preferred embodiment, the mounting cavity 4 is marginally larger than the framing hole 3; both the mounting cavity 4 and the framing hole 3 are of a rectangular shape and are sized complimentary for the placement of the glazing 7 and the backing 9 in their respective positions as seen in FIG. 3 and FIG. 4. The backing 9 is attached to the mounting cavity 4 through a set of backing fasteners 10. The set of backing fasteners 10 is perimetrically distributed around the backing 9 and are positioned in between the torso-shaped structural piece 2 and the backing 9. Fastener types include, but are not limited to, adhesive, bolts, screws, rivets, and other comparable means. In the preferred embodiment, a plurality of screws is perimetrically distributed about the backing 9 and is screwed into the complimentary threaded holes on the torso-shaped structural piece 2. Additionally, a plurality of spacers 11 is utilized in between the glazing 7 and the backing 9 to prevent the two components from rubbing against each other and possibly causing damage to one another. The plurality of spacers 11 is connected normal to the backing 9 and is positioned in between the backing 9 and the glazing 7. The plurality of spacers 11 is designed such that the spacers press up against the glazing 7.

Figure 5:
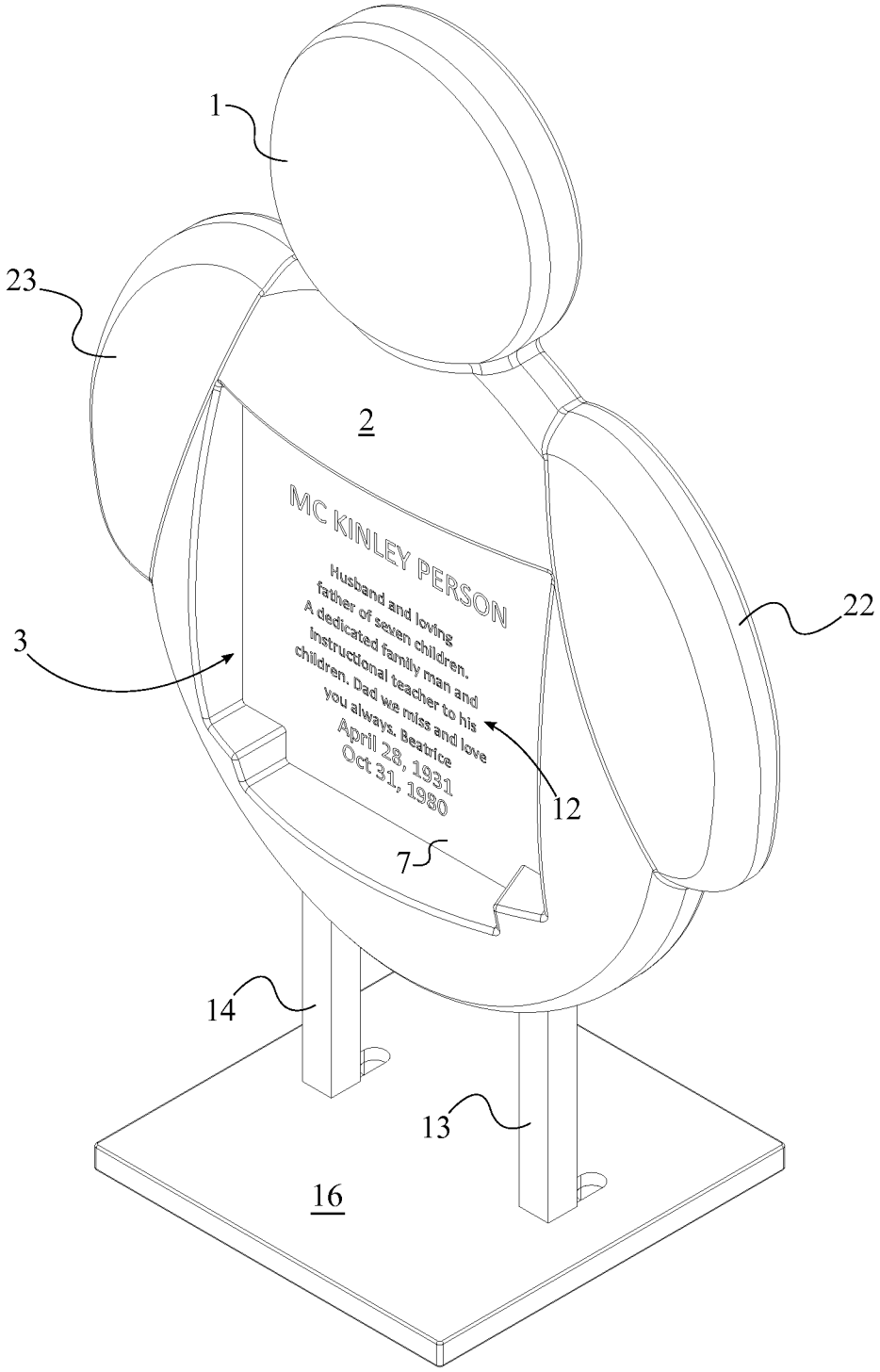
FIG. 5 is a front perspective view of the present invention, depicting the planar base component.

The present invention is meant to be anchored at a certain location and orientated in a vertical position to be displayed in clear view for all to see; this is achieved by the first leg 13, the second leg 14, and a planar base 16 in one embodiment. Both the first leg 13 and the second leg 14 are mounted into the torso-shaped structural piece 2, opposite to the head-shaped structural piece 1, via a leg fastening mechanism 17. The first leg 13 and the second leg 14 are positioned parallel to each other; offset a certain length from each other for increased stability. In addition, the first leg 13 and the second leg 14 each comprise a mounting end 15 that is positioned opposite to the torso-shaped structural piece 2 that is used to anchor the present invention into the ground. In the preferred embodiment, the mounting end 15 comprises a sharpened end with a helical screw wrapped around the shaft similar to a screwpile. Through the helical design the mounting end 15 can be anchored into the ground through a rotation motion; after both the first leg 13 and the second leg 14 are installed into the ground, the torso-shaped structural piece 2 and the associated components of the present invention may be attached. In alternative embodiments, various different anchoring systems may be utilized to hold the present invention in an upright orientation. In one embodiment, where the ground surface does not allow for drilling or screwpile anchoring, the planar base 16 is used. The planer base 16 is a horizontal plate that provides an anchoring medium for the first leg 13 and the second leg 14. The planar base 16 is positioned adjacent and normal to the first leg 13 and the second leg 14, opposite to the torso-shaped structural piece 2 as seen in FIG. 5. In this embodiment, the torso-shaped structural piece 2 is attached adjacent to both the first leg 13 and the second leg 14, opposite to the planar base 16.

The leg fastening mechanism 17 comprises a first leg-receiving cavity 18, a first set of fasteners 19, a second leg-receiving cavity 20, and a second set of fasteners 21. The first leg-receiving cavity 18 and the second leg-receiving cavity 20 are positioned parallel to each other, offset from each other a certain distance. The first leg-receiving cavity 18 and the second leg-receiving cavity 20 traverse into the torso-shaped structural piece 2, opposite the head-shaped structural piece 1 to facilitate the attachment of the first leg 13 and second leg 14 to the torso-shaped structural piece 2; the embedded cavities ensure a rigid connection between the first leg 13, second leg 14, and the torso-shaped structural piece 2. The first leg 13 is mounted into the first leg-receiving cavity 18 by the first set of fasteners 19; and, in a similar fashion the second leg 14 is mounted into the second leg-receiving cavity 20 by the second set of fasteners 21.

The present invention further comprises charms wherein the charms may be in various shapes and sizes. The charms may represent the deceased person's likes, activities, hobbies, or other symbols which represent the person. The charms are attached to the bottom planar base, the side, the pole, the first leg, or the second leg.

Although the invention has been explained in relation to its preferred embodiment, it is to be understood that many other possible modifications and variations can be made without departing from the spirit and scope of the invention as hereinafter claimed.

What is claimed is:

1. A personalized memorial display comprises:

a torso-shaped structural piece;

a glazing;

a backing;

a customized etching;

a first leg;

a second leg;

the torso-shaped structural piece comprises a framing hole and a mounting cavity;

the mounting cavity traversing into the torso-shaped structural piece;

the framing hole traversing into torso-shaped structural piece, opposite the mounting cavity;

the framing hole and the mounting cavity being coincidently positioned with each other;

the glazing being positioned within the mounting cavity, adjacent to the framing hole;

the backing being attached into the mounting cavity, opposite to the framing hole;

the customized etching being positioned on the glazing;

a leg fastening mechanism;

the leg fastening mechanism comprises a first leg-receiving cavity, a first set of fasteners, a second leg-receiving cavity, and a second set of fasteners;

the first leg-receiving cavity and the second leg-receiving cavity being positioned parallel to each other;

the first leg-receiving cavity and the second leg-receiving cavity being offset to each other;

the first leg being mounted into the first leg-receiving cavity by the first set of fasteners; and the second leg being mounted into the second leg-receiving cavity by the second set of fasteners.

2. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

the first leg and the second leg each comprise a mounting end;

the first leg and the second leg being positioned parallel to each other;

the first leg and the second leg being offset from each other; and the mounting end of both the first leg and the second leg being positioned opposite to the torso-shaped structural piece.

3. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a planar base;

the planar base being positioned adjacent and normal to the first leg and the second leg, opposite to the torso-shaped structural piece; and the torso-shaped structural piece being attached adjacent to both the first leg and the second leg, opposite to the planar base.

4. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a set of backing fasteners;

the set of backing fasteners being perimetrically distributed around the backing; and the set of backing fasteners being positioned in between the torso-shaped structural piece and the backing.

5. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

the glazing comprises a plurality of notches;

the mounting cavity comprises a plurality of tabs;

the plurality of notches being perimetrically distributed around the glazing;

the plurality of notches laterally traversing into the glazing;

the plurality of tabs being perimetrically distributed around the mounting cavity;

the plurality of tabs laterally traversing into the mounting cavity; and each of the plurality of tabs being positioned into a corresponding notch from the plurality of notches.

6. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a glazing-receiving lip;

the glazing-receiving lip being integrating into the torso-shaped structural piece from the mounting cavity; and the glazing being positioned within the glazing-receiving lip.

7. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a plurality of spacers;

the plurality of spacers being positioned in between the backing and the glazing;

the plurality of spacers being connected normal to the backing; and the plurality of spacers being pressed against the glazing.

8. The personalized memorial display as claimed in claim 1 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a left arm-shaped structural piece;

a right arm-shaped structural piece;

the left arm-shaped structural piece being adjacently connected to the torso-shaped structural piece;

the right arm-shaped structural piece being adjacently connected to the torso-shaped structural piece, opposite to the left arm-shaped structural piece; and the framing hole being positioned in between the left arm-shaped structural piece and the right arm-shaped structural piece.

9. A personalized memorial display comprises:

a torso-shaped structural piece;

a glazing;

a backing;

a customized etching;

a first leg;

a second leg;

the torso-shaped structural piece comprises a framing hole and a mounting cavity;

the mounting cavity traversing into the torso-shaped structural piece;

the framing hole traversing into torso-shaped structural piece, opposite the mounting cavity;

the framing hole and the mounting cavity being coincidently positioned with each other;

the glazing being positioned within the mounting cavity, adjacent to the framing hole;

the backing being attached into the mounting cavity, opposite to the framing hole;

the customized etching being positioned on the glazing;

the first leg and the second leg each comprise a mounting end;

the first leg and the second leg being positioned parallel to each other;

the first leg and the second leg being offset from each other;

the mounting end of both the first leg and the second leg being positioned opposite to the torso-shaped structural piece;

a leg fastening mechanism;

the leg fastening mechanism comprises a first leg-receiving cavity, a first set of fasteners, a second leg-receiving cavity, and a second set of fasteners;

the first leg-receiving cavity and the second leg-receiving cavity being positioned parallel to each other;

the first leg-receiving cavity and the second leg-receiving cavity being offset to each other;

the first leg being mounted into the first leg-receiving cavity by the first set of fasteners; and the second leg being mounted into the second leg-receiving cavity by the second set of fasteners.

10. The personalized memorial display as claimed in claim 9 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a planar base;

the planar base being positioned adjacent and normal to the first leg and the second leg, opposite to the torso-shaped structural piece; and the torso-shaped structural piece being attached adjacent to both the first leg and the second leg, opposite to the planar base.

11. The personalized memorial display as claimed in claim 9 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a set of backing fasteners;

the set of backing fasteners being perimetrically distributed around the backing; and the set of backing fasteners being positioned in between the torso-shaped structural piece and the backing.

12. The personalized memorial display as claimed in claim 9 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

the glazing comprises a plurality of notches;

the mounting cavity comprises a plurality of tabs;

the plurality of notches being perimetrically distributed around the glazing;

the plurality of notches laterally traversing into the glazing;

the plurality of tabs being perimetrically distributed around the mounting cavity;

the plurality of tabs laterally traversing into the mounting cavity; and each of the plurality of tabs being positioned into a corresponding notch from the plurality of notches.

13. The personalized memorial display as claimed in claim 9 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a glazing-receiving lip;

the glazing-receiving lip being integrating into the torso-shaped structural piece from the mounting cavity; and the glazing being positioned within the glazing-receiving lip.

14. The personalized memorial display as claimed in claim 9 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a plurality of spacers;

the plurality of spacers being positioned in between the backing and the glazing;

the plurality of spacers being connected normal to the backing; and the plurality of spacers being pressed against the glazing.

15. The personalized memorial display as claimed in claim 9 comprises:

a head-shaped structural piece;

the head-shaped structural piece being connected adjacent to the torso-shaped structural piece;

both the first leg and the second leg being mounted into the torso-shaped structural piece, opposite to the head-shaped structural piece;

the first leg-receiving cavity and the second leg-receiving cavity traversing into the torso-shaped structural piece, opposite the head-shaped structural piece;

a left arm-shaped structural piece;

a right arm-shaped structural piece;

the left arm-shaped structural piece being adjacently connected to the torso-shaped structural piece;

the right arm-shaped structural piece being adjacently connected to the torso-shaped structural piece, opposite to the left arm-shaped structural piece; and the framing hole being positioned in between the left arm-shaped structural piece and the right arm-shaped structural piece.

* * * * *